US006426465B1

(12) United States Patent
Kosuge

(10) Patent No.: US 6,426,465 B1
(45) Date of Patent: Jul. 30, 2002

(54) PROTECTIVE COVER FOR BATTERY CONNECTION TERMINAL, AND ASSEMBLY OF THE PROTECTIVE COVER AND BATTERY CONNECTION TERMINAL

(75) Inventor: Shuji Kosuge, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 67 days.

(21) Appl. No.: 09/580,427

(22) Filed: May 30, 2000

(30) Foreign Application Priority Data

May 27, 1999 (JP) ..... 11-148389
May 27, 1999 (JP) ..... 11-148390

(51) Int. Cl.[7] ..... H01B 17/00

(52) U.S. Cl. ..... 174/138 F; 174/135; 174/188; 174/190; 174/191; 174/137 R; 174/138 R; 439/522; 439/904; 439/903

(58) Field of Search ..... 174/138 F, 135, 174/188, 190, 191; 439/522, 904, 903

(56) References Cited

U.S. PATENT DOCUMENTS 4,035,051 A * 7/1977 Guy ..... 339/103 R
4,698,459 A * 10/1987 Drake ..... 174/138 F
5,169,338 A * 12/1992 Dewar et al. ..... 439/522
5,338,898 A * 8/1994 Luciano et al. ..... 174/138 F
5,346,407 A 9/1994 Hood
5,439,759 A * 8/1995 Lippert et al. ..... 429/65
5,576,516 A 11/1996 Kameyama et al. ..... 174/138 F
5,804,770 A * 9/1998 Tanaka ..... 174/138 F
5,910,029 A * 6/1999 Siedlik et al. ..... 439/522
5,931,690 A * 8/1999 Sai et al. ..... 439/350

FOREIGN PATENT DOCUMENTS

EP 0546710 A2 11/1992
EP 0603872 A2 12/1993
WO WO 98/35394 8/1998

* cited by examiner

*Primary Examiner*—Dean A Reichard
*Assistant Examiner*—Jinhee Lee
(74) *Attorney, Agent, or Firm*—Oliff & Berridge PLC

(57) ABSTRACT

A protective cover has a body in which an electrical wire connection part of a battery connection terminal is installed and a cover piece covering a clamping part of the terminal and hinged to the body. The cover piece contains a pair of elastically deformable locking arms extending vertically. The body has receiving portions locking lip portions of the locking arms thereto when the cover piece is closed. The locking arms are protected inside the cover piece and are sufficiently flexible to reduce risk of breakage on repeated opening and closing.

12 Claims, 10 Drawing Sheets

PROTECTIVE COVER FOR BATTERY CONNECTION TERMINAL, AND ASSEMBLY OF THE PROTECTIVE COVER AND BATTERY CONNECTION TERMINAL

BACKGROUND OF THE INVENTION

1. Field of the Invention

The present invention relates to a protective cover for a battery connection terminal, and to an assembly of such a protective cover and terminal. The present invention is particularly applicable in the connection of an electrical wire to a battery post of a battery, e.g. a lead-acid battery, in a vehicle or boat, for example.

2. Description of the Related Art

Generally, a connection terminal connected with a battery post is covered with a protective cover to prevent it from being shorted to a vehicle body. A cover of this kind is disclosed in U.S. Pat. No. 5,576,516. In this construction, for holding the protective cover in its closed state, lugs on the inner surface of the cover lock into slots on a base member.

However, in such a construction, the lugs are liable to be broken or chipped, because they rub on the base member every time that opening and closing of the cover is repeated. As a result, there is a possibility that the cover becomes unable to be closed. Further, when the lug is formed on the protective cover, a "sink mark" may be formed on the exterior surface thereof during molding.

SUMMARY OF THE INVENTION

A construction may be conceived in which, instead of the lug, an elastic locking piece is used to elastically lock the protective cover. However, in this case it is necessary to form a slit on a side wall of the protective cover. Thus, this construction does not provide a good appearance.

The present invention seeks to remove or reduce the above-described disadvantages. Thus, it is an object of the present invention to provide a protective cover for a battery terminal which has a good appearance and has a reliable locking state.

According to the invention there is provided a protective cover for a battery connection terminal, including a body member adapted to receive and enclose an electrical wire connection part of the battery connection terminal, and a cover member having a top wall and opposite side walls and adapted to cover upper and side portions of a clamping part of the battery connection terminal when the clamping part is clamped onto a terminal post of a battery. For locking of the cover member to the body member, the cover member has at its interior at least one elastically deformable locking member having a free end spaced from and displaceable relative to an adjacent side wall of the cover member by its elastic deformation. The body member has a locking formation adapted to make locking connection with the locking member, thereby to hold the cover member in position covering the clamping part of the battery connection terminal.

In the invention, when the cover member is closed, the locking formation locks the locking member thereto and elastically holds the cover member in position, with the cover member covering the clamping portion of the terminal. Because the cover member is locked to the body member by utilizing the elasticity of the locking member, the locking construction is less likely to be damaged, unlike the known locking construction in which a non-elastic or low elasticity lug is used. Thus, the locking construction provides a reliable locking performance for a long time. Further, because the locking member is disposed inside the cover member and is not exposed to the outside, the appearance of the protective cover is good.

In one embodiment, the locking member has two mutually perpendicular edge portions spaced from its free end and is connected to an adjacent side wall and a top wall of the cover member at the two mutually perpendicular edge portions. To achieve such a connection of the locking member, the side wall may have a joggle or step formation, connecting a wider part and a narrower part of the cover member. Alternatively, the locking member may be in a form of a cantilever arm having a second end remote from the free end and connected to the top wall of the cover member at the second end.

When the cover member and the body member are connected hingedly to each other, the protective cover can be handled easily.

Preferably, in the locked-together position of the cover member and the body member, the body member and cover member are restrained from relative movement in all of the upward, downward, forward and rearward directions, as well as in the two lateral directions. Accordingly, in the case where the body member and cover member are hinged, even if the hinge is cut or broken, the cover member is not lost from the body member, and its use can continue.

The invention also provides the assembly of the protective cover and the battery connection terminal.

BRIEF DESCRIPTION OF THE DRAWINGS

Embodiments of the invention will now be described by way of non-limitative example, with reference to the accompanying drawings, in which.

DETAILED DESCRIPTION OF THE PREFERRED EMBODIMENTS

Figure 1:
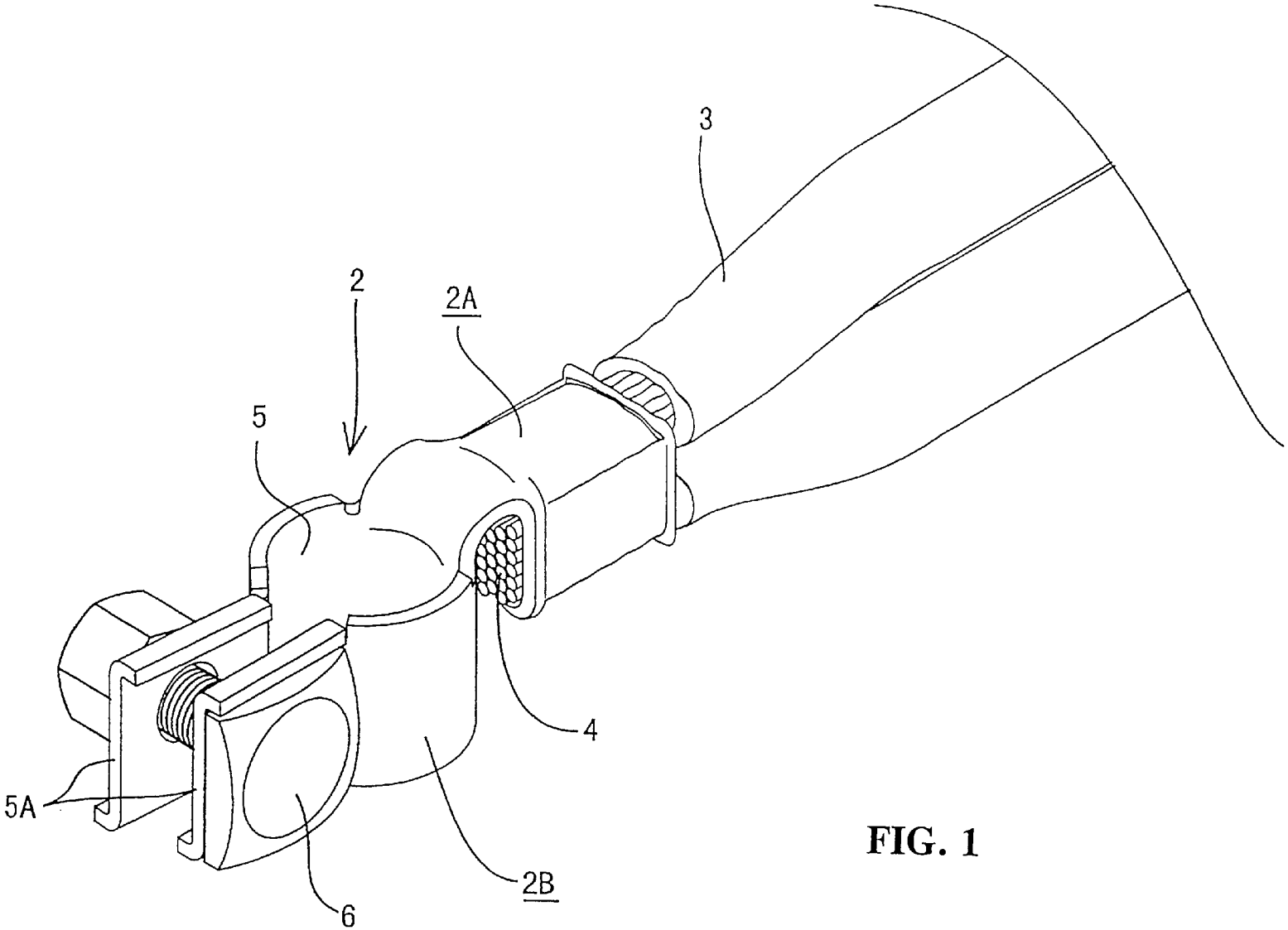
FIG. 1 is a perspective view of a typical battery connection terminal secured to an electric wire, to which the present invention may be applied.

In the embodiments of the present invention described below with reference to the drawings, a battery connection terminal 2 is covered by a protective cover 1. The terminal 2 is shown in FIG. 1 without the protective cover 1 and is made of an electrically conductive metal. The terminal 2 has an electrical wire connection part 2A at which a bundle of bare core wires 4 of a covered wire 3 are crimped, and a clamping part 2B connected in use with a battery post (not shown). The clamping part 2B for clamping the battery post has an axially short, split clamping ring 5, which is approximately cylindrical (in practice usually tapered). A pair of overhangs or lugs 5A project from respective ends of the split clamping ring 5 and accommodate a fastening bolt 6. The diameter of the clamping ring 5 can be reduced by the fastening bolt 6, to clamp the clamping ring 5 onto the battery post in a conventional manner.

The protective cover 1 shown in FIGS. 2 to 8 is preferably made of a suitable synthetic resin material and is preferably produced by one-piece molding, e.g. injection molding. The protective cover 1 includes a body 1A which in use holds and covers the electrical wire connection part 2A and the clamping ring 5 by enclosing them but does not cover the lugs 5A, and a cover piece 1B connected with the body 1A through an integral hinge 7 and in use covering upper and side portions of the clamping part 2B including the lugs 5A and bolt 6. As can be seen in the drawings, in its closed position, the cover piece 1B at its narrower portion overlays with the body A.

The body 1A is open at its bottom face and its end faces, and is approximately inverted U-shaped in cross-section to allow insertion of the terminal 2 and a part of the front end of the electrical wire 3 through the bottom opening. The front end portion of the body 1A is wide, forming a part-annular holding portion 8 for accommodating the clamping ring 5 of the terminal 2. The inner wall of the holding portion 8 is so formed that it contacts the peripheral surface of the unclamped clamping ring 5 closely. The width of the portion of the body 1A rearward from the holding portion 8 is almost equal to that of the electrical wire connection part 2A.

Figure 2:
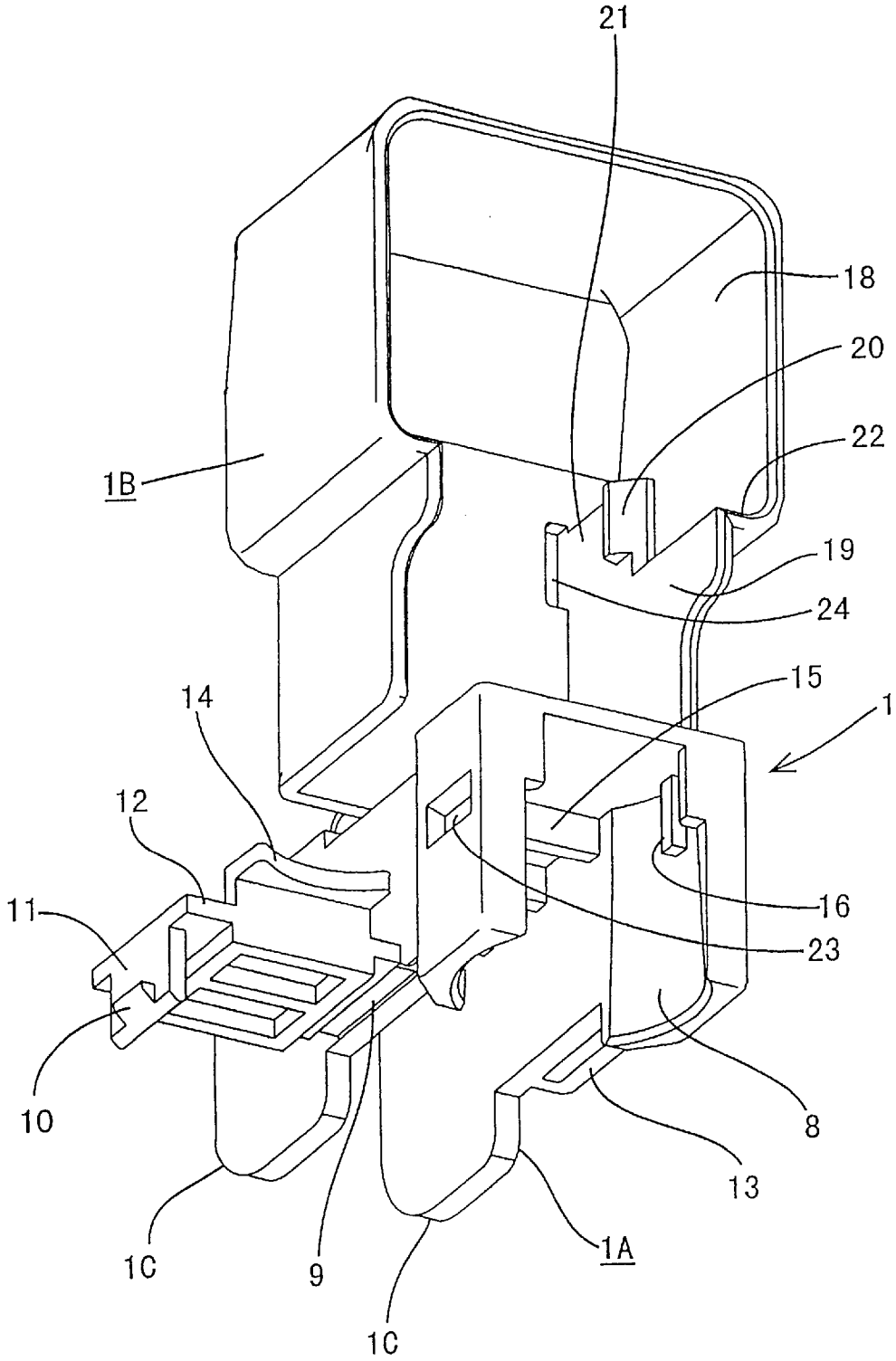
FIG. 2 is a perspective view of a first protective cover of one embodiment of the present invention for use with the terminal of FIG. 1, showing an open state of the cover piece.

As shown in FIG. 2, the side walls of the body 1A have central recessed portions at their bottom edges. An integral thin connection edge or web 9 is longitudinally formed to join the recessed portion of one of the side walls. A flap 12 is connected with this side wall through the web 9, which acts as a hinge such that the flap 12 can be opened and closed. The flap 12 closes around underneath a portion of the electrical wire connection part 2A, thus preventing removal of the terminal 2 from the cover 1.

Figure 5:
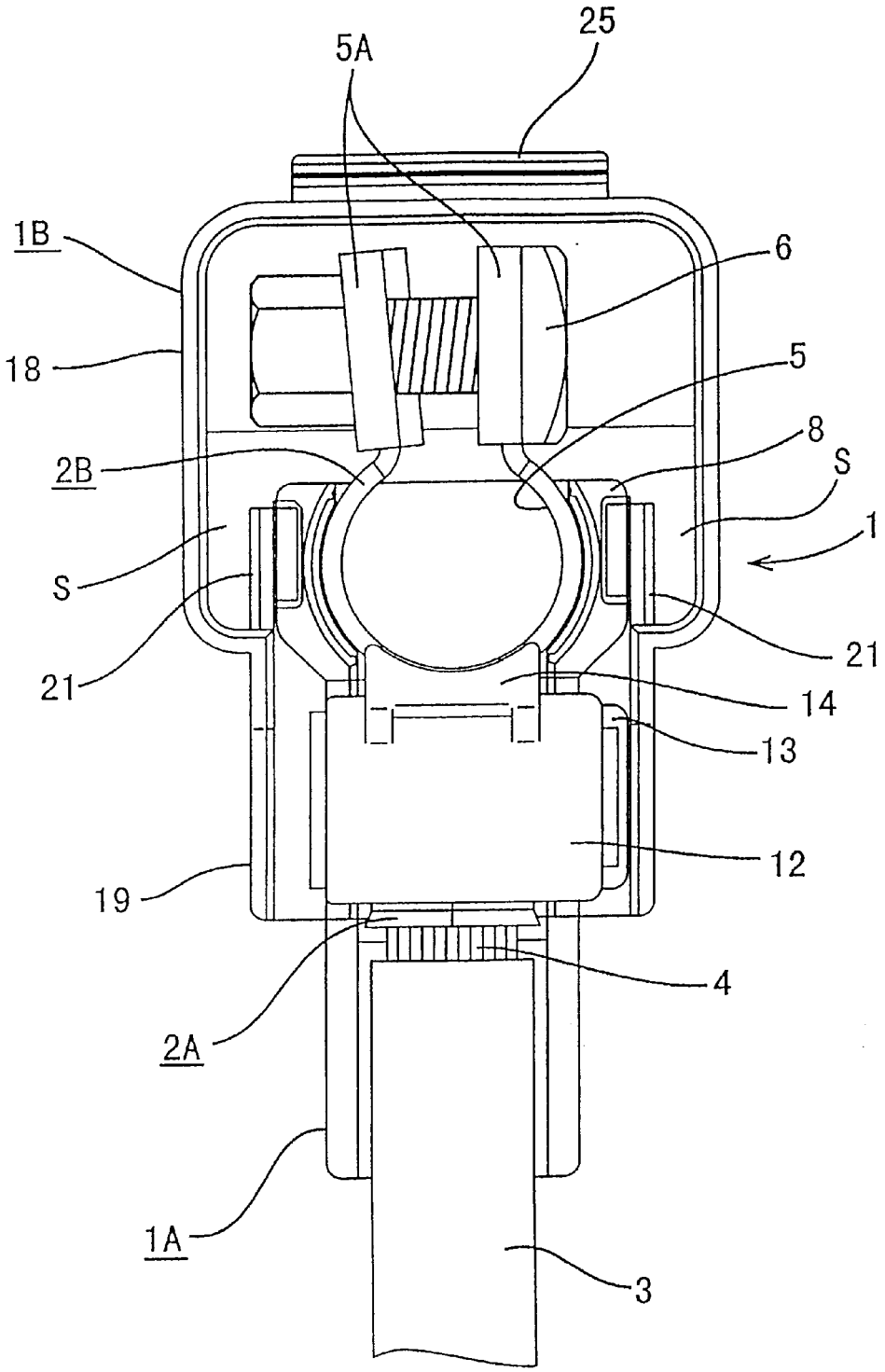
FIG. 5 is a bottom view of the protective cover of FIG. 2, showing a state in which a battery terminal is accommodated in the protective cover.

A locking piece 11 having a locking lip 10 formed at its extremity is formed at an edge of the flap 12, on the side opposite to the connection web 9. When the flap 12 is closed, the locking lip 10 is pressed into a latching portion 13 projecting from the corresponding recessed portion of the other side wall of the body 1A and locked thereto. The flap 12 is thus held in a closed state. A pressing piece 14 whose front end is, for example, a circular arc is formed on the flap 12 at an edge thereof confronting the holding portion 8. The pressing piece 14 includes a portion extending perpendicularly downward (in the closed state) from the bottom surface of the flap 12 and a portion projecting forward from this perpendicular portion. As shown in FIG. 5, in the state in which the clamping ring 5 is accommodated in the holding portion 8, the pressing piece 14 does not project over the interior of the clamping ring 5 but contacts the peripheral bottom surface of the clamping ring 5, thus helping to prevent the terminal 2 from being loose in the cover 1.

Figure 3:
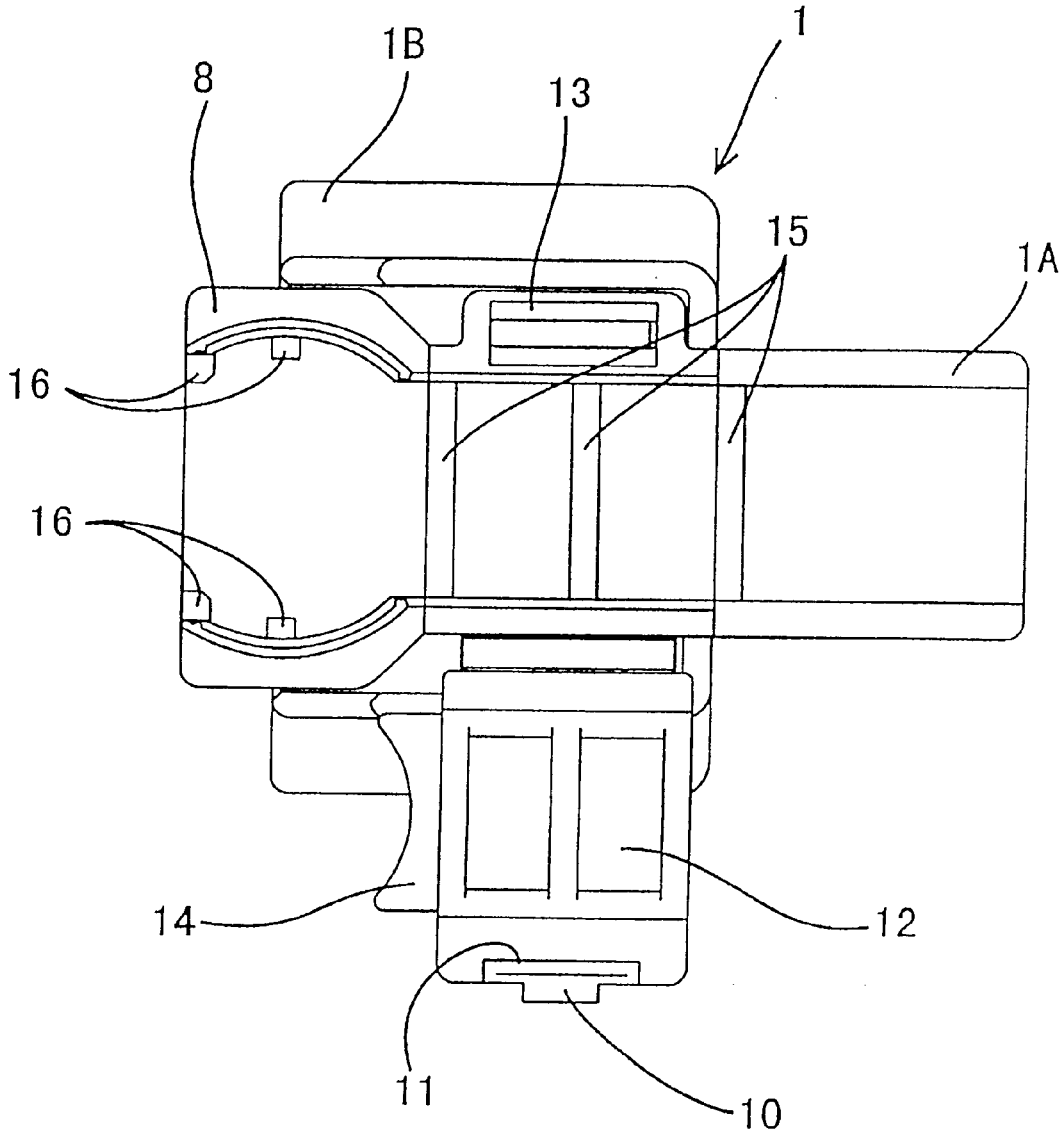
FIG. 3 is a bottom view of the protective cover of FIG. 2.
Figure 4:
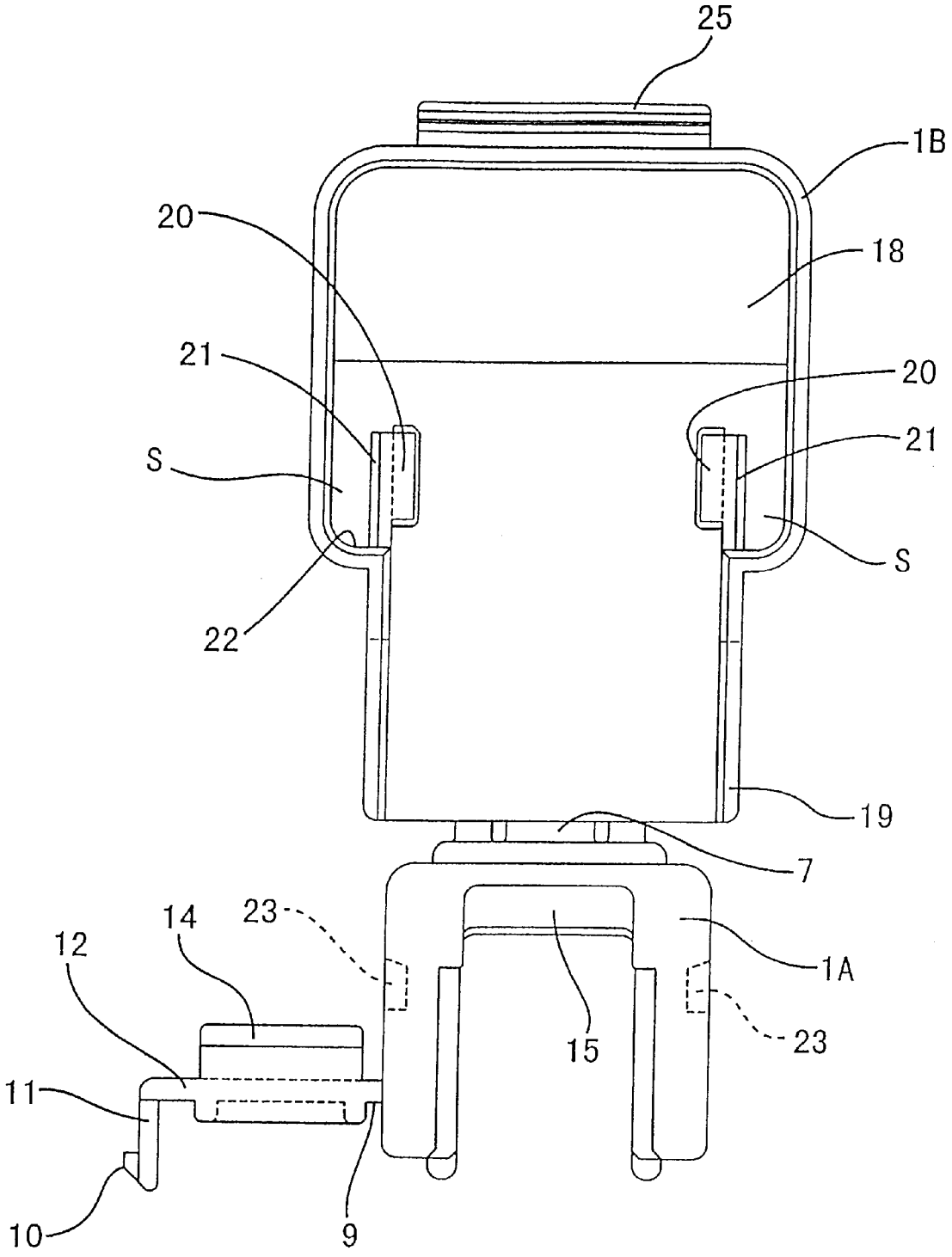
FIG. 4 is a side view of the protective cover of FIG. 2, showing a state in which a cover piece and a locking flap are opened.
Figure 8:
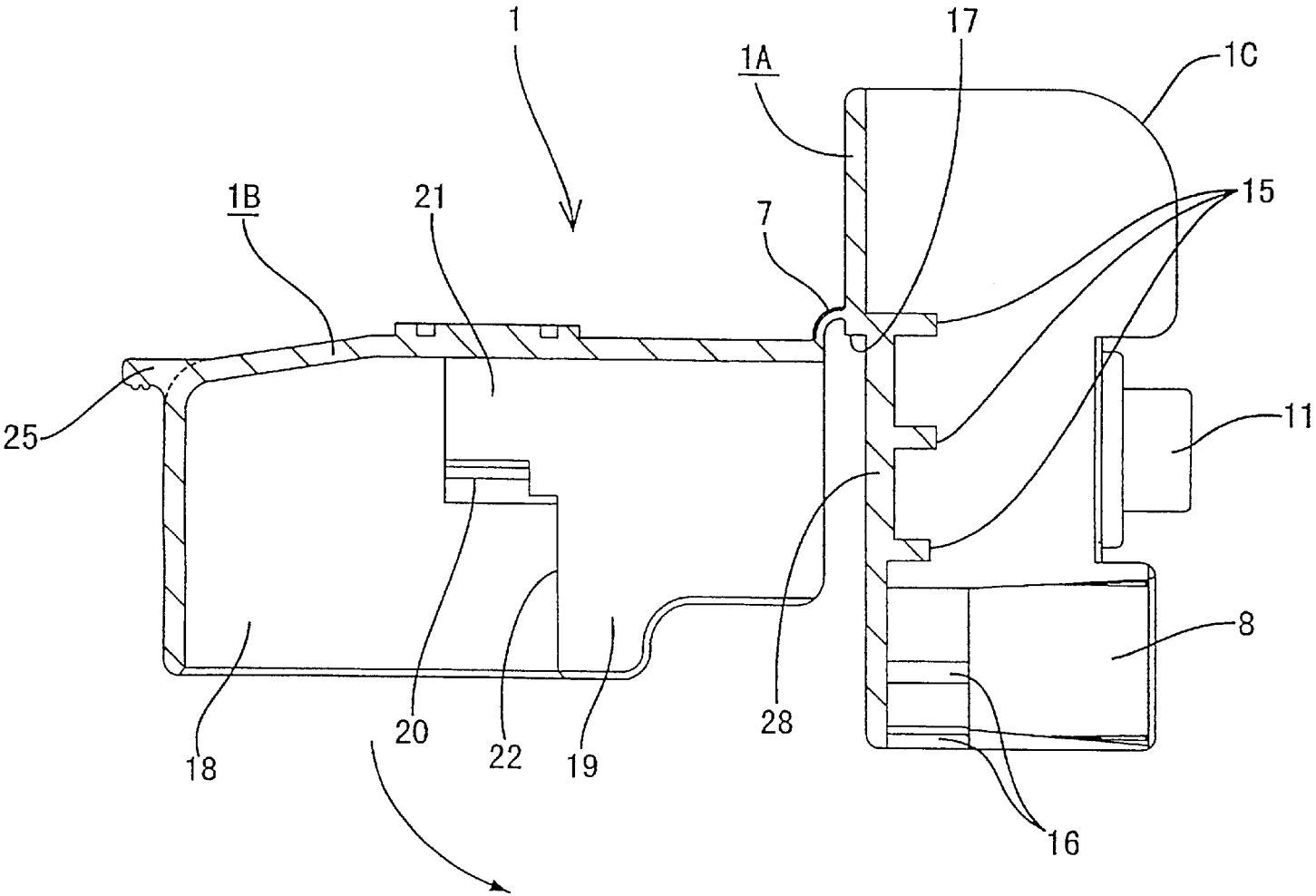
FIG. 8 is a sectional view of the protective cover of FIG. 2, showing a state in which the cover piece is open.

As shown in FIGS. 3 and 8, three downwardly projecting ribs 15 are formed widthwise at the centre of the top wall of the body 1A. Two locating convexities or ribs 16, which may, for example, have a square pillar shape, are formed in each side wall off the holding portion 8 next to each end portion of the inner top surface of the holding portion 8. The ribs 15 and ribs 16 contact the electric wire connection part 2A and the clamping part 2B of the terminal 2, respectively, thus regulating the insertion depth of the terminal 2 into the body 1A. More specifically, the periphery of the bottom surface of the clamping ring 5 is made flush with the bottom surface of the holding portion 8.

Figure 6:
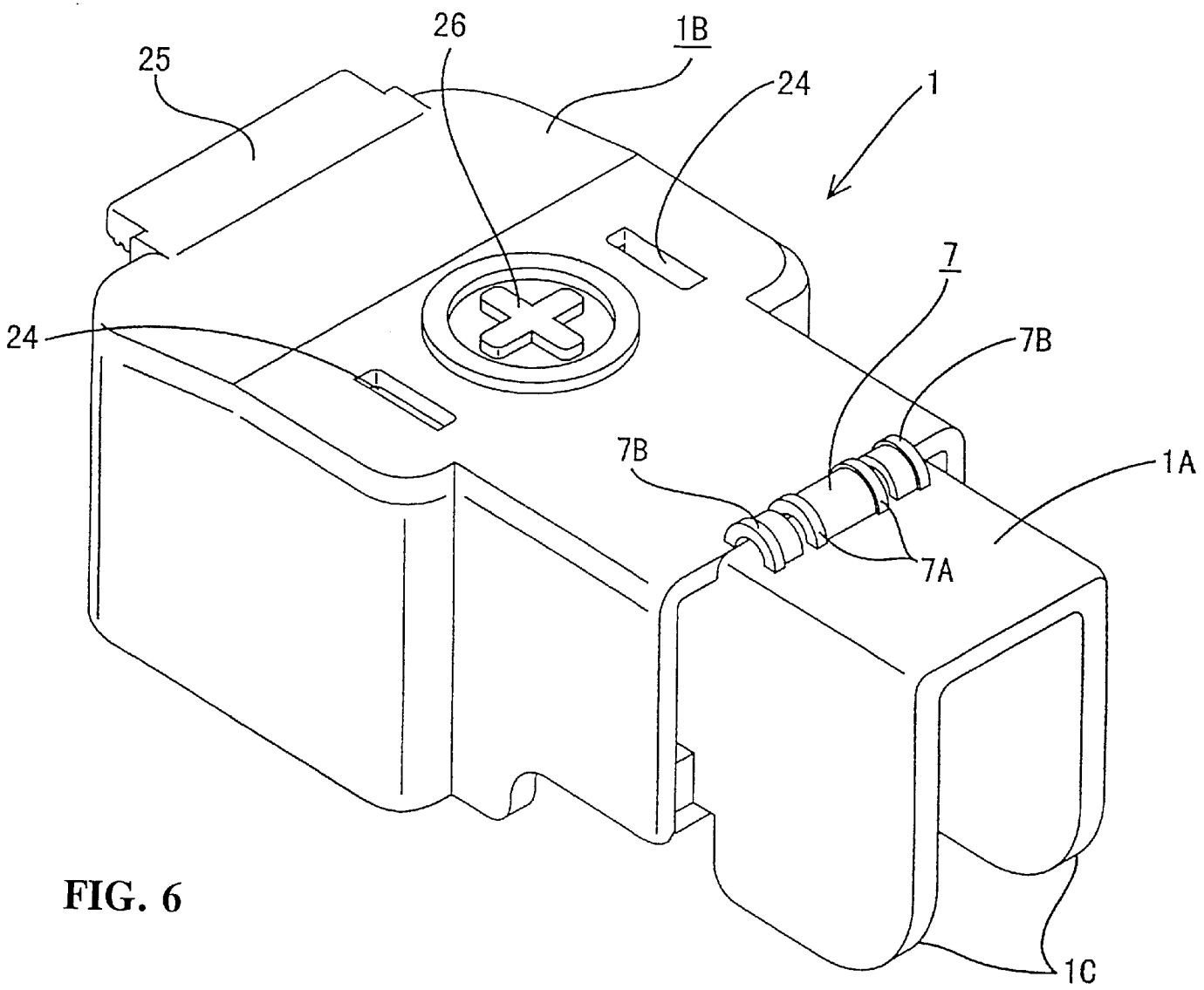
FIG. 6 is a perspective view of the protective cover of FIG. 2, showing a closed state of the cover piece.

The cover piece 1B is attached to the body 1A through the integral hinge 7 such that the cover piece 1B is pivotable relative to the body 1A. As shown in FIG. 8, the body 1A has a step 17 in its top wall so that its rear portion is higher. The hinge 7 is formed widthwise on the high rear portion in the vicinity of the step 17. As shown in FIG. 6, the hinge 7 in this embodiment is divided into three parts. Thick reinforcing portions 7A are formed on both edges of the centre part of the hinge 7. Similarly, thick reinforcing portions 7B are formed on an outer edge of each side part of the hinge 7. The shaping and rigidity of the hinge 7 is such that, supposing that the cover piece 1B is open in its natural or unrestrained state (no external force applied), the cover is kept in its open position when an operation such as clamping the terminal 2 is to be accomplished, with the bolt 6 exposed.

The entire cover piece 1B is wider than the body 1A. The cover piece 1B can be closed so as to cover the front part of the body 1A, with the cover piece 1B located above the body 1A. The front half portion (hereinafter referred to as wide portion 18) of the cover piece 1B is wider than the rear half portion (hereinafter referred to as base portion 19) and when closed accommodates the clamping bolt 6 of the terminal 2.

For holding the cover piece 1B in a closed state, the cover piece 1B has a pair of opposed locking members in a form of arms 21 each having a hook-like laterally projecting lip portion 20 at the free end thereof. Each locking arm 21 is disposed inside the wide portion 18 such that it extends vertically (parallel to the adjacent side wall) in the vicinity of the boundary between the wide portion 18 and the base portion 19. In this embodiment, the locking arms 21 are formed by extending respective inner surfaces of the base portion 19 to overlap the wide portion 18 such that the locking arms 21 are flush with the base portion 19. More specifically, a first edge of each locking arm 21 joins the top wall of the wide portion 18, and a second edge thereof, perpendicular to the first edge, joins a step surface 22 formed between the wide portion 18 and the base portion 19. Because the locking arm 21 is formed on the step surface 22, a gap exists between the locking arm 21 and the inner surface of the wide portion 18, thus serving as a space S permitting elastic deformation of the locking arm 21 (see FIG. 4). The free end carrying the lip portion 20 is thus resiliently displaceable relative to the side wall of the cover piece 1B.

Figure 7:
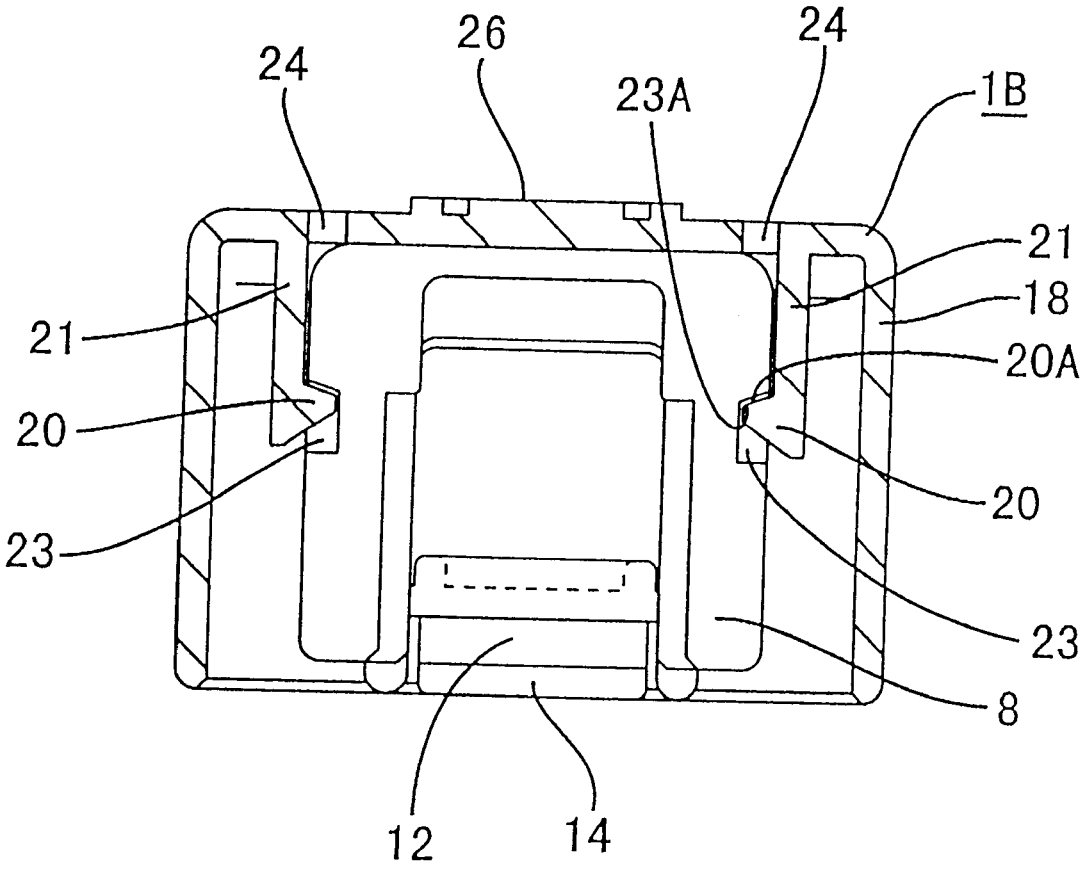
FIG. 7 is a sectional view of the protective cover of FIG. 2, showing a locked state of locking arms.

As shown in FIG. 7, when the body 1A is closed by the cover piece 1B, the locking arms 21 are elastically locked in a latching manner to corresponding recesses 23 of the body 1A, by the application of suitable manual force. The recesses 23 may, for example, have a square shape on an outer surface of the two side walls of the annular holding portion 8. In this embodiment, each recess 23 has a wall surface at each of its four sides. Accordingly, the lip portion 20 of the locking arm 21 is retained by all of the four wall surfaces of the recess 23 so that, when the cover piece 1B is closed, it is incapable of moving vertically or horizontally with respect to the body 1A. Thereby, even if the hinge 7 is cut or broken, as may happen due to rough handling, the closed state of the cover piece 1B can be maintained and the cover piece 1B can be repeatedly re-used.

As shown in FIG. 7, an upwardly inclined surface 20A of the tapered lip 20 of the locking arm 21 contacts a corresponding upwardly inclined surface 23A of the upper edge of the receiving portion 23. Thereby, by opening the cover piece 1B with a suitable manual force, the tapered lip 20 can be forcibly unlocked.

As shown in FIGS. 6 and 7, die cutting openings 24 for shaping each tapered lip 20 of the locking arm 21 penetrate through the top wall of the cover piece 1B. A sign portion 26 for indicating that the battery post is a positive (or negative as appropriate) electrode projects from the upper surface of the cover piece 1B, interposed between the two openings 24.

As shown in FIG. 6, an operating handle 25 for use in performing an opening operation projects from the front end of the upper surface of the cover piece 1B. When the cover piece 1B is closed, the bottom surface of the cover piece 1B and that of the rear end portion of the body 1A (i.e. rearwardly from the zone of the flap 12) are flush with each other. The rear edge portion of the bottom surface of the body 1A is preferably curved to form a circular arc surface 1C. The circular arc surface 1C is formed to allow the cover 1 to pivot easily on an installing surface when fitting the clamping ring 5 onto a battery post.

The operation of connecting the cover 1 having the above construction to a battery post will now be described. With the flap 12 open, the terminal 2 connected to the electrical wire 3 is inserted into the body 1A of the cover 1. At this time, the terminal 2 contacts the ribs 15 and 16 so that the insertion depth of the terminal 2 into the body 1A is regulated. Then, the flap 12 is closed and the locking lip 10 of the locking piece 11 is inserted into the latching portion 13 of the body 1A to lock the lip 10 thereto. As a result, the flap 12 holds the terminal 2 in the body 1A. Further, the pressing piece 14 presses the periphery of the clamping ring 5 so as to fix the position of the terminal 2.

Then, with the cover piece 1B open, the battery post is inserted into the clamping ring 5, and the clamping ring 5 is tightened by the clamping bolt 6. In this manner, the operation of connecting the terminal 2 and the battery post is completed. Then, the cover piece 1B is pivoted on the hinge 7. As a result, the lip portion 20 of each locking arm 21 slides along the outer surface of the holding portion 8 and elastically deforms. When each lip portion 20 reaches the corresponding recess 23, it is restored to its original state, i.e. the lip portion 20 drops into the recess 23 and is caught by the four wall surfaces of the recess 23. In this manner, the connection zone of the battery post and the terminal 2 is covered by the cover piece 1B.

As described above, in this embodiment of the present invention, the cover piece 1B is locked to the body 1A by the elastic locking arms 21 which can easily be displaced relative to the adjacent side walls of the cover piece 1B. Thus, when locking and unlocking operations are repeated, the locking arms 21 are hardly damaged and thus a stable closing situation can be obtained. Further, because the locking arms 21 are disposed inside the cover piece 1B and are not exposed to the outside, the cover 1 does not have a poor appearance and the arms 21 are protected. Furthermore, because the lip portion 20 of each locking arm 21 is locked in an opening (recess) of the body 1A having wall surfaces at the four sides, the locking arm 21 is held vertically and horizontally. Accordingly, even if the hinge 7 is cut or broken, the cover piece 1B is not removed from the body 1A, and thus it is possible to keep the battery terminal 2 closed.

Figure 9:
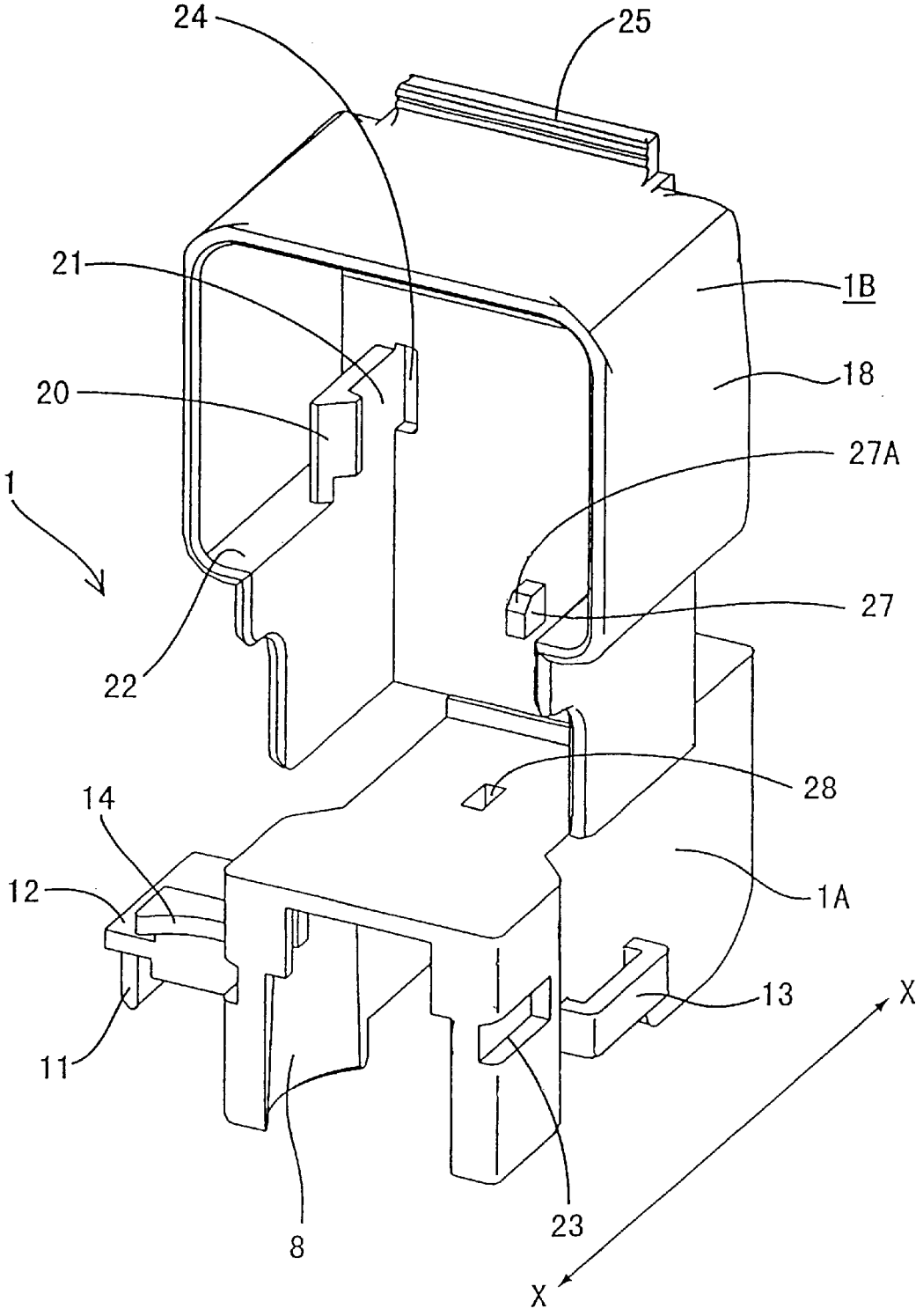
FIG. 9 is a perspective view of a protective cover of another embodiment, for use with the terminal of FIG. 1, showing the open state of the cover piece.
Figure 10:
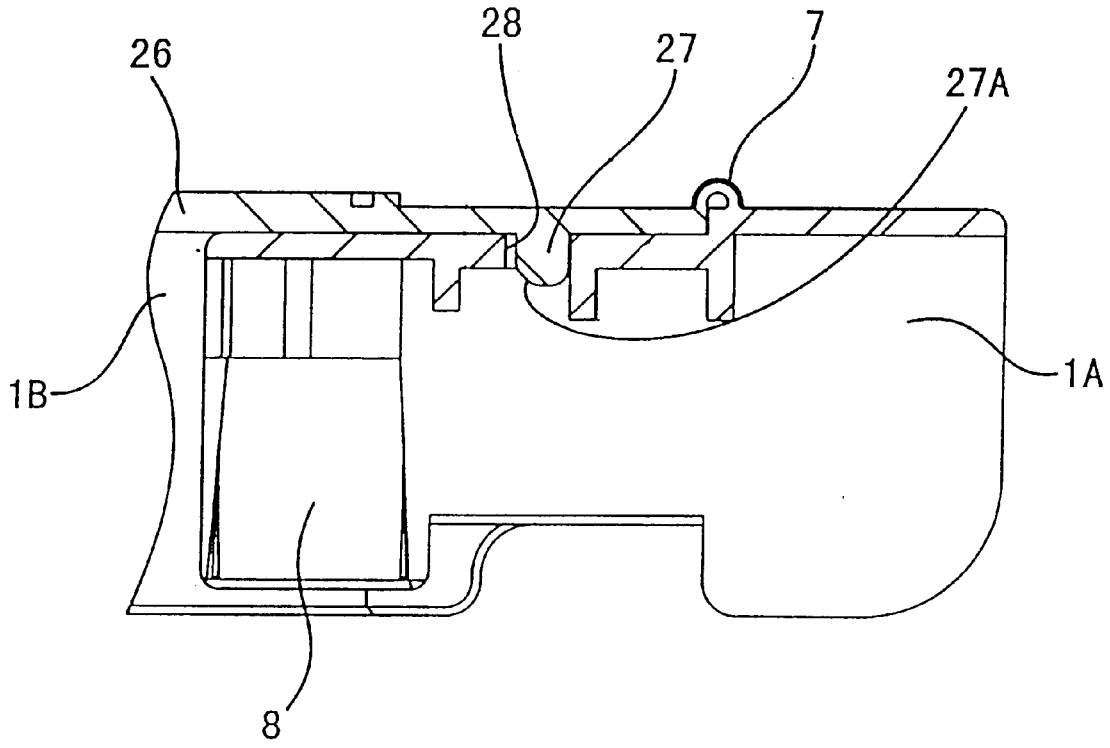
FIG. 10 is a partial cross-sectional view of the protective cover of FIG. 9, with the cover piece being closed.

FIGS. 9 and 10 show a modified embodiment of the protective cover of the invention. Except as mentioned below, this embodiment is the same as that of FIGS. 2 to 8. The same reference numerals are used for corresponding parts. For ease of molding, the receiving recesses 23 in the side walls of the body 1A extend to the forward ends of the side walls, so that they do not have bounding wall portions at their forward ends. Therefore, when received in these recesses 23, the lip portions 20 of the locking arms are restrained in the up and down directions but not restrained in the forward/rearward directions indicated by the arrows X-X. To prevent relative forward and rearward movement of the body 1A and the cover piece 1B, the cover piece 1B has a downward projection or lug 27 on its top wall, which engages tightly in an aperture 28 in the top wall of the body 1A when the cover piece 1B is closed (see FIG. 10). The front edge 27A of the lug 27 is chamfered or rounded to allow its tight insertion into the aperture 28. This construction reduces load accidentally applied to the hinge 7.

The present invention is not limited to the embodiments described above. For example, modifications such as those described below are possible and are included in the scope of the present invention.

In the embodiments, two edges of each locking arm 21 join the top of the wide portion 18 and the stepped surface 22 respectively, but the locking arms 21 may alternatively be formed integrally with only the top wall of the cover piece 1B, so that they are of a cantilever type, connected only at an end remote from the free end 20.

Furthermore, in the embodiments, two locking arms 21 are employed. However, the number of the locking arms is not limited to two.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A protective cover for a battery connection terminal, comprising:

a body member adapted to receive an electrical wire connection part of said battery connection terminal; and a cover member having a top wall and a pair of opposite side walls, said cover member adapted to cover upper and side portions of a clamping part of said battery connection terminal when said clamping part is clamped onto a terminal post of a battery, wherein, at least one elastically deformable locking member is provided in an interior of said cover member and has a free end spaced from and displaceable relative to an adjacent one of said side walls of said cover member due to elastic deformation of the locking member, and said body member has at least one locking formation adapted to make locking connection with said free end of said at least one locking member, thereby to hold said cover member in position covering said clamping part of said battery connection terminal.

2. A protective cover according to claim 1, wherein said locking member has two mutually perpendicular edge portions spaced from said free end and is connected to the adjacent one of said side walls and said top wall of said cover member at said two mutually perpendicular edge portions.

3. A protective cover according to claim 1, wherein said locking member comprises a cantilever arm having a second end remote from said free end and being connected to said top wall of said cover member at said second end.

4. A protective cover according to claim 1, wherein said at least one elastically deformable locking member comprises a pair of elastically deformable locking members that are provided in the interior of said cover member respectively adjacent to said pair of opposite side walls thereof, and said at least one locking formation comprises a pair of locking formations on opposite sides of said body member to receive said pair of elastically deformable locking members respectively.

5. A protective cover according to claim 4, wherein said body member has a pair of side walls, and said locking formations are each one of a recess and an aperture in respective ones of said side walls.

6. A protective cover according to claim 1, wherein each of said body member and said cover member has a rear end and a front end, and the protective cover has a hinge connecting said body member and said cover member whereby said cover member is pivotable with respect to the body member.

7. A protective cover member according to claim 1, wherein, in the locked-together position of said cover member and said body member, said body member and cover member are restrained from relative movement in all of the upward, downward, forward, rearward and lateral directions.

8. A protective cover according to claim 6, wherein said locking formation has front, rear, top and bottom wall portions arranged such that, when said locking member is in locking connection with said locking formation, relative movement of said locking member and said body member is restricted in forward, rearward, upward and downward directions by said wall portions respectively.

9. A protective cover according to claim 6, wherein said locking formation has top and bottom wall portions arranged such that, when said locking member is in locking connection with said locking formation, relative movement of said locking member and said body member is restricted in upward and downward directions by said wall portions respectively, and one of said cover member and said body member has a projection arranged to engage the other of said cover member and said body member, when said cover member and said body member are in the locked together position, so as to prevent relative forward and rearward movement thereof.

10. An assembly comprising a battery connection terminal and protective coverfor the battery connection terminal, said battery connection terminal having a front end and a rear end and comprising an electrical wire connection part adapted for making secure connection to an electrical wire and, forwardly thereof, a clamping part adapted for making a clamping connection onto a terminal post of a battery; and said protective cover comprising a body member adapted to receive said electrical wire connection part of said battery connection terminal, and a cover member having a top wall and a pair of opposite side walls, said cover member adapted to cover upper and side portions of said clamping part of said battery connection terminal;

wherein at least one elastically deformable locking member is provided in an interior of said cover member and has a free end spaced from and displaceable relative to an adjacent one of said side walls of said cover member due to elastic deformation of the locking member, and said body member has at least one locking formation adapted to make locking connection with said free end of said at least one locking member, thereby to hold said cover member in position covering said clamping part of said battery connection terminal.

11. An assembly according to claim 10, wherein said protective cover has a hinge connecting said body member and said cover member whereby said cover member is pivotable with respect to the body member.

12. An assembly according to claim 10, wherein said body member of said protective cover has a locking arm arranged to be brought to a locked position in which said locking arm spans across an underside of said battery connection terminal, after said battery connection terminal has been inserted into said body member.

* * * * *